US010252089B2

(12) United States Patent
Berney-Smith et al.

(10) Patent No.: US 10,252,089 B2
(45) Date of Patent: Apr. 9, 2019

(54) MONITORING APPARATUS

(71) Applicant: Draeger Safety UK Limited, Blyth, Northumberland (GB)

(72) Inventors: Marcus Berney-Smith, Morpeth (GB); Norman John Webster, Cramlington (GB)

(73) Assignee: DRAEGER SAFETY UK LIMITED, Blyth, Northumberland (GB)

( * ) Notice: Subject to any disclaimer, the term of this patent is extended or adjusted under 35 U.S.C. 154(b) by 843 days.

(21) Appl. No.: 14/599,078

(22) Filed: Jan. 16, 2015

(65) Prior Publication Data

US 2015/0231421 A1 Aug. 20, 2015

(30) Foreign Application Priority Data

Feb. 14, 2014 (GB) ..... 1402592.8

(51) Int. Cl.

| | |
|---|---|
| ***A62B 17/04*** | (2006.01) |
| ***A62B 27/00*** | (2006.01) |
| ***A62B 9/00*** | (2006.01) |
| ***A62B 9/02*** | (2006.01) |
| ***A62B 18/02*** | (2006.01) |

(52) U.S. Cl.

CPC ..... *A62B 27/00* (2013.01); *A62B 9/006* (2013.01); *A62B 9/022* (2013.01); *A62B 18/02* (2013.01)

(58) Field of Classification Search

CPC ..... A62B 27/00; A62B 18/02; A62B 9/022; A62B 9/006

See application file for complete search history.

(56) References Cited

U.S. PATENT DOCUMENTS

| | | | | |
|---|---|---|---|---|
| 5,157,378 | A * | 10/1992 | Stumberg | A62B 9/006 2/8.1 |
| 5,689,234 | A | 11/1997 | Stumberg et al. | |
| 5,781,118 | A | 7/1998 | Wise et al. | |
| 6,995,665 | B2 * | 2/2006 | Appelt | G08B 21/182 128/204.23 |
| 8,085,144 | B2 * | 12/2011 | Appelt | A61B 5/02055 128/201.22 |

(Continued)

FOREIGN PATENT DOCUMENTS

| | | |
|---|---|---|
| CN | 202620520 U | 12/2012 |
| EP | 0801368 | 10/1997 |

(Continued)

OTHER PUBLICATIONS

European Search Report dated May 21, 2015 from corresponding European Application No. 15151907.1.

(Continued)

*Primary Examiner* — Steven O Douglas
(74) *Attorney, Agent, or Firm* — DLA Piper LLP (US)

(57) ABSTRACT

A monitoring apparatus for monitoring a wearer of a breathing apparatus including a source of breathable gas which is supplied to a delivery device via a fluid line, the monitoring apparatus including a breathing detector arranged to determine if breathing using the breathing apparatus has commenced, and a mobile monitoring device arranged to be associated with the wearer and which can be activated to monitor the motion of the wearer. The monitoring apparatus is arranged to activate the mobile monitoring device when it is determined that breathing has commenced.

18 Claims, 2 Drawing Sheets

(56) References Cited

U.S. PATENT DOCUMENTS

| | | | | |
|---|---|---|---|---|
| 9,390,609 | B2 * | 7/2016 | Hogg | G08B 21/0453 |
| 9,586,065 | B2 * | 3/2017 | Losos | A62B 9/04 |
| 2007/0176769 | A1 | 8/2007 | Boss | |

FOREIGN PATENT DOCUMENTS

| | | |
|---|---|---|
| EP | 2591826 | 5/2013 |
| GB | 2496402 | 5/2013 |

OTHER PUBLICATIONS

Great Britain Search Report dated Aug. 22, 2014 from corresponding GB Application No. 1402592.8.
Chinese Search Report dated Jul. 18, 2018, from counterpart Chinese Application No. 2015100766778.

* cited by examiner

MONITORING APPARATUS

The present application claims priority to GB 1402592.8 filed on 14 Feb. 2014, which is hereby incorporated by reference in its entirety for any and all purposes.

BACKGROUND

The invention relates to an apparatus for monitoring a wearer of breathing apparatus.

Breathing apparatus, such as self-contained breathing apparatus (SCBA), is frequently used by persons working in hazardous environments. Breathing apparatus typically comprises a cylinder of breathable gas mounted on a harness carried by the user, and a delivery device, such as a facemask having a lung-demand valve, that supplies the breathable gas to the user. A pressure gauge, such as a manual gauge or a digital gauge, is usually provided so that the wearer can monitor the amount of breathable gas remaining in the cylinder.

A mobile monitoring device such as a PASS (Personal Alert Safety System) or ADSU (Automatic Distress Signal Unit) is often used with breathing apparatus and in some cases is required by law. A PASS/ADSU comprises a motion sensor that monitors the motion of the wearer and an alarm, for example an audible or visual alarm, that is activated if a lack of motion is detected for a pre-determined period of time. A lack of motion may indicate that the wearer is injured or incapacitated and the alarm is used to alert rescue personnel to the location of the wearer.

It is important that the mobile monitoring device is turned on before the wearer enters the hazardous environment. This is typically done by pressing a combination of manual buttons or removing a tally key from the device. GB 2 496 402 discloses monitoring apparatus in which a mobile monitoring device is turned on when it has been detected that the gas supply has been turned on. Accordingly, the mobile monitoring device is automatically turned on when the wearer turns the gas supply on.

However, wearers of breathing apparatus are frequently required to remain outside of a hazardous environment in readiness for deployment into the environment. Although they are waiting to be deployed, the gas supply of their breathing apparatus is turned on so that they can immediately enter the hazardous environment when instructed. In such circumstances an activated PASS/ADSU will sound the alarm if a lack of motion is detected. Motionless wearers awaiting deployment can therefore be frequently disturbed by an alarm unnecessarily, and must manually turn off the alarm each time it is activated.

It is therefore desirable to provide an improved apparatus for monitoring a wearer of breathing apparatus.

According to an aspect of the invention there is provided a monitoring apparatus for monitoring a wearer of breathing apparatus comprising a source of breathable gas which in use is supplied to a delivery device via a fluid line, the monitoring apparatus comprising: a breathing detector arranged to determine if breathing using the breathing apparatus has commenced; and a mobile monitoring device arranged to be associated with the wearer and which can be activated to monitor the motion of the wearer; wherein the apparatus is arranged to activate the mobile monitoring device when it is determined that breathing has commenced. The delivery device may comprise a face mask and/or a lung demand valve.

The mobile monitoring device may be arranged to be attached to the wearer.

The breathing detector may be arranged to monitor a signal relating to a parameter of fluid in the fluid line. The breathing detector may be arranged to determine if breathing has commenced based on the signal.

The signal may comprise a pressure signal relating to the pressure of fluid in the fluid line. The monitoring apparatus may comprise a pressure sensor which is arranged to generate the pressure signal.

The breathing detector may determine that breathing has commenced when the pressure signal indicates that the pressure of fluid in the fluid line has fallen by at least a predetermined pressure. The breathing detector may determine that breathing has commenced when the pressure signal indicates that the pressure of fluid in the fluid line has fallen at a rate that is at least a predetermined rate.

The signal may comprise a flow rate signal relating to the flow rate of fluid in the fluid line. The monitoring apparatus may comprise a flow rate sensor which is arranged to generate the flow rate signal. The breathing detector may determine that breathing has commenced when the flow rate signal indicates that the flow rate of fluid in the fluid line is at least a predetermined flow rate.

The monitoring apparatus may further comprise a gas supply detector arranged to determine if breathable gas is being supplied to the delivery device.

The monitoring apparatus may be arranged to activate the mobile monitoring device when it is determined that both breathable gas is being supplied to the delivery device and breathing has commenced.

The monitoring apparatus may be arranged such that the breathing detector starts determining if breathing has commenced only once the gas supply detector has determined that breathable gas is being supplied to the delivery device.

The gas supply detector may be arranged to monitor a signal relating to a parameter of fluid in the fluid line. The gas supply detector may determine if breathable gas is being supplied based on the signal.

The signal may comprise a pressure signal relating to the pressure of fluid in the fluid line. The monitoring apparatus may comprise a pressure sensor which generates a pressure signal relating to the pressure of fluid in the fluid line.

The gas supply detector may determine that breathable gas is being supplied when the pressure signal indicates that the pressure of fluid in the fluid line is at least a predetermined pressure.

According to a further aspect of the invention there is provided breathing apparatus comprising: a source of breathable gas fluidically coupled to a delivery device via a fluid line, such that in use breathable gas can be supplied to the delivery device via the fluid line; and a monitoring apparatus in accordance with any statement herein. The delivery device may comprise a face mask and a lung demand valve. The source of breathable gas may comprise a cylinder of breathable gas.

According to a further aspect of the invention there is provided a method of activating a mobile monitoring device which is arranged to be associated with a wearer of breathing apparatus comprising a source of breathable gas which in use is supplied to a delivery device via a fluid line, the method comprising: determining if breathing using the breathing apparatus has commenced; and activating the mobile monitoring device to monitor the motion of the wearer when it is determined that breathing has commenced.

The mobile monitoring device may be arranged to be attached to the wearer.

The method may further comprise monitoring a signal relating to a parameter of fluid in the fluid line. Determining if breathing has commenced may be based on the signal.

The signal may comprise a pressure signal relating to the pressure of fluid in the fluid line. It may be determined that breathing has commenced when the pressure signal indicates that the pressure of fluid in the fluid line has fallen by at least a predetermined pressure. It may be determined that breathing has commenced when the pressure signal indicates that the pressure of fluid in the fluid line has fallen at a rate that is at least a predetermined rate.

The signal may comprise a flow rate signal relating to the flow rate of fluid in the fluid line. It may be determined that breathing has commenced when the flow rate signal indicates that the flow rate of fluid in the fluid line is at least a predetermined rate.

The method may further comprise determining if breathable gas is being supplied to the delivery device.

The mobile monitoring device may be activated when it is determined that both breathable gas is being supplied to the delivery device and breathing has commenced. Determining if breathing has commenced may only start once it has been determined that breathable gas is being supplied to the delivery device.

The method may further comprise monitoring a signal relating to a parameter of fluid in the fluid line. Determining if breathable gas is being supplied may be based on the signal.

The signal may comprise a pressure signal relating to the pressure of fluid in the fluid line. It may be determined that breathable gas is being supplied when the pressure signal indicates that the pressure of fluid in the fluid line is at least a predetermined pressure.

The invention may comprise any combination of the features and/or limitations referred to herein, except combinations of such features as are mutually exclusive.

SUMMARY OF THE INVENTION

An exemplary embodiment of the present invention comprises a monitoring apparatus for monitoring a wearer of breathing apparatus comprising a source of breathable gas which in use is supplied to a delivery device, such as a face mask and/or a lung demand valve, via a fluid line, the monitoring apparatus comprises a pressure sensor arranged to generate a pressure signal relating to the pressure of fluid in the fluid line; a breathing detector arranged to determine if breathing using the breathing apparatus has commenced, the breathing detector being arranged to monitor the pressure signal and to determine if breathing has commenced based on the pressure signal; a gas supply detector arranged to determine if breathable gas is being supplied to the delivery device; and a mobile monitoring device arranged to be associated with the wearer and which can be activated to monitor the motion of the wearer; wherein the apparatus is arranged to activate the mobile monitoring device when it is determined that both breathable gas is being supplied to the delivery device and breathing has commenced.

Another exemplary embodiment of the present invention comprises a monitoring apparatus for monitoring a wearer of breathing apparatus comprising a source of breathable gas which in use is supplied to a delivery device via a fluid line, the monitoring apparatus comprises a breathing detector arranged to determine if breathing using the breathing apparatus has commenced; and a mobile monitoring device arranged to be associated with the wearer and which can be activated to monitor the motion of the wearer; wherein the apparatus is arranged to activate the mobile monitoring device when it is determined that breathing has commenced.

Another exemplary embodiment of the present invention comprises a method of activating a mobile monitoring device which is arranged to be associated with a wearer of breathing apparatus comprising a source of breathable gas which in use is supplied to a delivery device via a fluid line, the method comprises determining if breathing using the breathing apparatus has commenced; and activating the mobile monitoring device to monitor the motion of the wearer when it is determined that breathing has commenced.

BRIEF DESCRIPTION OF THE DRAWINGS

Embodiments of the invention will now be described, by way of example, with reference to the accompanying drawings, in which.

DETAILED DESCRIPTION

Figure 1:
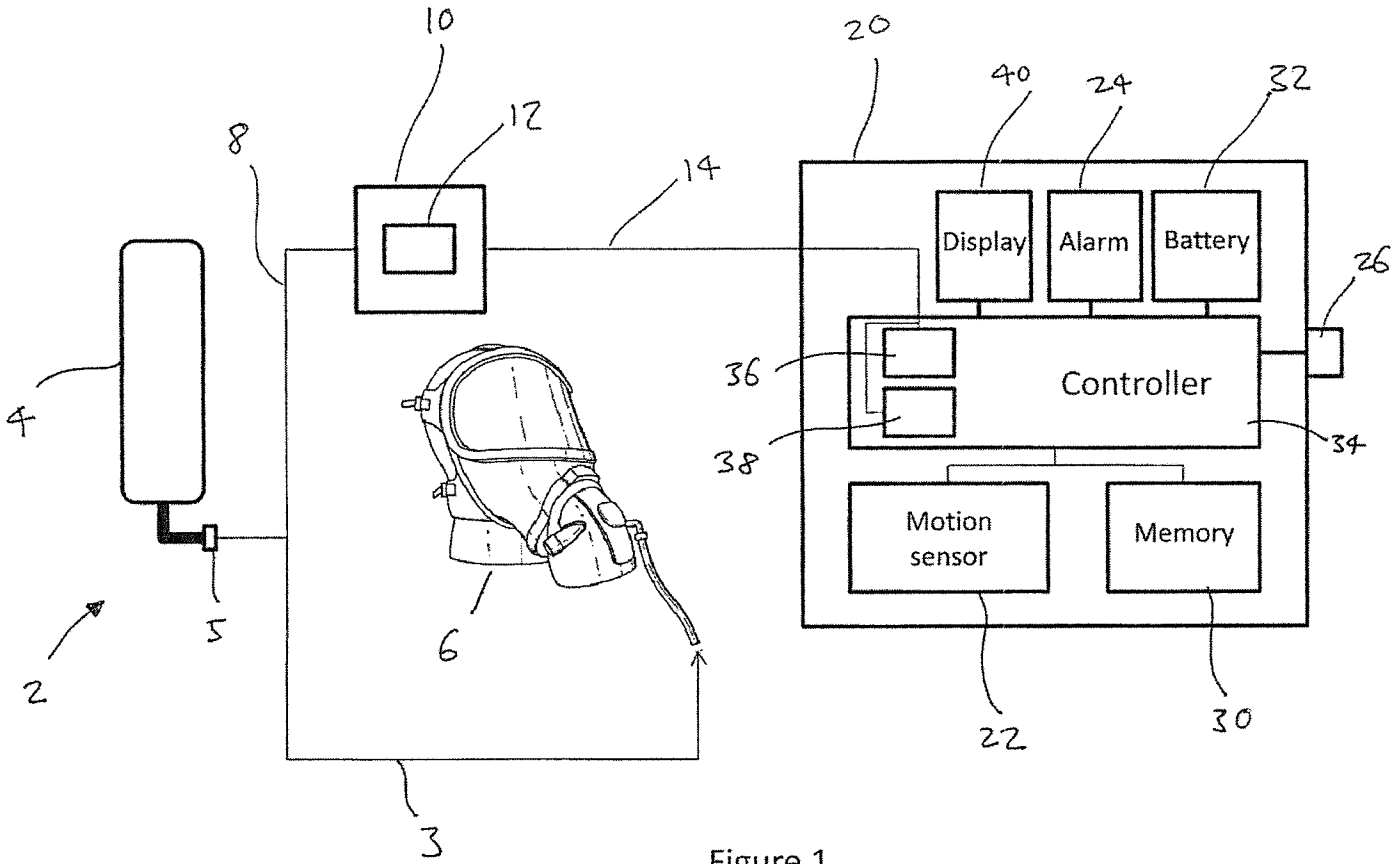
FIG. 1 schematically shows breathing apparatus comprising a monitoring apparatus in accordance with an embodiment of the invention.

FIG. 1 shows breathing apparatus 2 comprising a breathable gas supply 4 fluidically coupled to a delivery device 6 via a supply line 3. The apparatus 2 also comprises a monitoring apparatus for monitoring a wearer of the breathing apparatus 2 comprising a pressure detecting device 10 and a mobile monitoring device 20. In this embodiment the breathable gas supply 4 is a cylinder of breathable gas, and the delivery device 6 is a face mask having a lung-demand valve. The pressure detecting device 10 and the mobile monitoring device 20 are discrete devices that in this embodiment are battery powered.

The pressure detecting device 10 comprises a pressure transducer 12 and is arranged to transmit an electronic pressure signal to the monitoring device 20. The mobile monitoring device 20 comprises a motion sensor 22, an alarm 24, a push button 26, a memory 30, a battery 32 and a display 40 which are all connected to a controller 34. The mobile monitoring device 20 provides the functions of a PASS (Personal Alert Safety System) or ADSU (Automatic Distress Signal Unit) and may comply with the requirements of JCDD/38 and/or BS10999 and/or NFPA 1982.

The mobile monitoring device 20 is arranged to monitor the motion of a wearer of the breathing apparatus 2, such as a fire-fighter. Accordingly, the mobile monitoring device 20 is provided with attachment means (not shown) for attaching the mobile monitoring device 20 to either the wearer, or to the breathing apparatus 2 itself such that it is associated with the wearer of the breathing apparatus. The attachment means may be a clip, for example.

When the mobile monitoring device 20 has been activated, the motion sensor 22, in combination with the controller 34, monitors the movement of the wearer. If the motion sensor 22 has not detected motion for a pre-determined period of time, for example 20-30 seconds, the mobile monitoring device 20 moves to a pre-alarm mode in which the alarm 24 is activated. The lack of detection of motion may indicate that the wearer is in distress. The pre-alarm can be cancelled by pressing a combination of buttons 26 or by movement. If the pre-alarm mode is not cancelled within a predetermined period of time, the alarm 24 will sound in a full-alarm mode in which it sounds at a higher level. In alternative embodiments, the mobile monitoring device 20 may be configured to indicate distress by transmitting a distress signal by a wireless link, for example by radio, to a base station or to other personnel within the hazardous environment.

When the mobile monitoring device is in a deactivated state, the motion sensor 22 and controller 34 either do not monitor the movement of the wearer, or the alarm 24 is disabled from sounding if a lack of motion is detected.

It is clearly important for the wearer that the mobile monitoring device 20 is activated by the time the wearer enters the hazardous environment. In this embodiment, the monitoring apparatus is arranged so that the mobile monitoring device 20 is automatically activated once it has been determined that breathable gas is being supplied to the delivery device 6 and that breathing using the breathing apparatus 2 (i.e. from the face mask) has commenced. Accordingly, the mobile monitoring device 20 is automatically activated only when the wearer has started using the breathing apparatus 2. Therefore, the alarm will not sound if the wearer has only turned on the gas supply in readiness to enter the hazardous environment, but has not begun to breathe using the breathing apparatus.

The pressure detecting device 10 is arranged to be connected to a fluid line 8 which is in fluid communication with the cylinder of breathable gas 4 of the breathing apparatus 2. In this embodiment, the pressure transducer 12 of the pressure detecting device 10 is connected downstream of the main cylinder valve 5 so that it only detects gas pressure when the cylinder valve 5 is open. The pressure transducer 12 is an electrical pressure transducer which converts the pressure detected into a digital pressure signal relating to the pressure of the gas in the fluid line. In this embodiment, the pressure detecting device 10 is connected to the monitoring device 20 with a wired link 14 such that the digital pressure signal is transmitted to the controller 34. In other embodiments, the pressure signal may be transmitted by a wireless link, or the pressure detecting device 10 may be integrated with the mobile monitoring device 20, for example.

Further, whilst the pressure signal in this embodiment is a digital representation of the pressure of the fluid in the fluid line 8, in other embodiments the pressure signal may be an analogue signal proportional to the pressure of the fluid, or the pressure signal may only indicate when the pressure has exceeded or dropped below one of a number of predetermined thresholds.

The mobile monitoring device 20 also comprises a display 40 which displays the actual pressure within the line 8. The actual pressure may be calculated within the pressure detecting device 10 or the mobile monitoring device 20.

The controller 34 of the mobile monitoring device 20 provides the functionality of a gas supply detector module 36 and a breathing detector module 38. These modules are arranged to make determinations regarding use of the breathing apparatus based on the pressure signal.

The gas supply detector module 36 is arranged to determine if breathable gas is being supplied to the face mask and lung demand valve 6. The gas supply detector module 36 is arranged to monitor the pressure signal received from the pressure detecting device 10 and determines that breathable gas is being supplied to the delivery device when the pressure signal indicates that the gas pressure in the fluid line exceeds a predetermined on threshold. In this embodiment, the predetermined on threshold is 8 bar.

The gas supply detector module 36 is also arranged to determine if the pressure signal indicates that the gas pressure in the fluid line is less than a predetermined off threshold. The predetermined off threshold is set so that a pressure signal indicating a gas pressure of below the off threshold indicates that the gas supply 4 has either been turned off or has been exhausted. In this embodiment, the predetermined off threshold is 8 bar (the same as the predetermined on threshold).

The breathing detector module 38 is arranged to determine if breathing using the breathing apparatus 2 has commenced. The breathing detector module 38 is arranged to monitor the pressure signal received from the pressure detecting device 10 and determines that breathing has commenced when the pressure signal is indicative of breathing. Specifically, the breathing detector module 38 determines that breathing using the breathing apparatus 2 has commenced when the pressure signal indicates the pressure of the gas in the fluid line has fallen from a baseline pressure by at least a predetermined pressure. The baseline pressure is a value stored in the memory 30 of the mobile monitoring device 20 which corresponds to the highest monitored pressure value. Typically, the baseline pressure corresponds to the pressure in the fluid line immediately after the cylinder valve 5 is opened and breathable gas is first supplied to the delivery device 6. However, the baseline pressure is reset if the pressure signal indicates that the pressure of the gas in the fluid line has increased.

Breathable gas is therefore supplied to the lung demand valve of the delivery device 6 though the fluid line 3, and the pressure detecting device 10 through the fluid line 8. The pressure in the fluid line 3 and in the fluid line 8 are directly related to one another. Therefore, the pressure detected by the pressure detecting device 10 is related to the pressure in the line 3 supplying the face mask and lung demand valve. The pressure in the line 3 may be a medium pressure and the pressure in the line 8 may be a high pressure. There may be a pressure drop between the breathable gas supply and the fluid lines 3, 8. The pressures in the two lines 5, 8 may be substantially the same.

In this embodiment, the delivery device 6 is a face mask provided with a lung demand valve. The lung demand valve only provides breathable gas to the wearer when the wearer inhales (i.e. on the demand of the wearer). Accordingly, when breathable gas is being supplied to the delivery device 6 but breathing has not yet commenced, the pressure of the breathable gas is substantially constant. When the user starts to breathe, the pressure reduces as the breathable gas is consumed.

Figure 2:
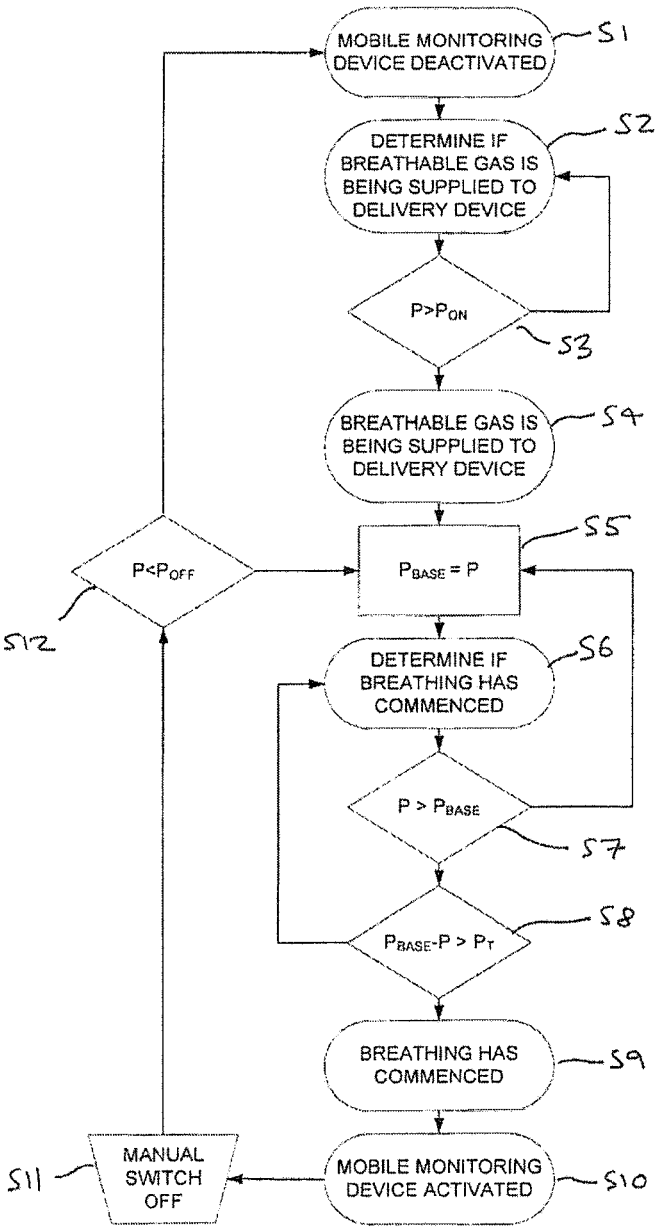
FIG. 2 schematically shows a method of activating the mobile monitoring device of FIG. 1.

The method by which the mobile monitoring device 20 is activated will now be described with reference to FIG. 2.

In use, a wearer dons the breathing apparatus 2 including the monitoring apparatus with the mobile monitoring device 20 in a deactivated (or standby) state, S1, in which it does not actively monitor the motion of the wearer. The pressure detecting device 10 generates a pressure signal relating to the pressure P of the fluid in the fluid line 8, and transmits this pressure signal to the mobile monitoring device 20.

Although the mobile monitoring device 20 is in a deactivated state, the gas supply detector module 36 operates and monitors the pressure signal to determine if breathable gas is being supplied to the delivery device 6, S2. In S3, if the pressure signal indicates that the pressure P in the fluid line is above the on threshold $P_{ON}$, it is determined that breathable gas is being supplied, S4, otherwise, the gas supply detector module 36 returns to S2. When the cylinder valve 5 is opened, breathable gas fills the fluid lines 3, 8 and therefore the pressure P in the fluid lines 3, 8 increases to above the on threshold $P_{ON}$ and it is determined that breathable gas is being supplied, S4. This pressure value P is then stored in the memory 30 as a baseline value $P_{BASE}$, S5. The process then proceeds to the breathing detector module 38 determining if breathing has commenced using the breathing apparatus 2, S6.

In S7, the pressure signal is monitored and if it indicates that the pressure P has risen above the baseline pressure $P_{BASE}$, the pressure baseline $P_{BASE}$ is reset as this new higher pressure value P, S5.

The pressure signal is monitored to determine if it indicates that breathing using the breathing apparatus has commenced. This is done by determining if the pressure P has dropped by more than a predetermined threshold $P_T$, S8. If it is determined that the pressure P in the fluid line has fallen by more than this threshold $P_T$, it is determined that breathing using the breathing apparatus has commenced, S9. Otherwise, the breathing detector module 38 returns to S6. When a user dons the facemask of the delivery device 6 and breathes, breathable gas is consumed and therefore the pressure P in the fluid line 8 drops. Therefore, once breathing commences and the pressure P drops by more than the threshold $P_T$, it is determined that breathing has commenced, S9. Following this, the mobile monitoring device 20 is immediately automatically activated S10.

Accordingly, the mobile monitoring device 20 is only activated to monitor the motion of the wearer when it is determined that both breathable gas is being supplied to the delivery device 6 and that breathing has commenced. The breathing detector module 38 only starts determining if breathing has commenced following it being determined that breathable gas is being supplied to the delivery device 6. Therefore, the wearer is able to open the cylinder valve 5 in readiness to enter a hazardous environment, and the alarm 24 of the mobile monitoring device 20 will not go off even if the wearer stands motionless. In the activated state of the mobile monitoring device 20, the alarm 24 sounds if the mobile monitoring device 20 detects a lack of motion for the predetermined period of time. The alarm may be cancelled by pushing the push button 26.

When the wearer exits the hazardous environment (or the mobile monitoring device 20 has been accidentally activated), the mobile monitoring device 20 can be deactivated. This is initialised by pushing the push button 26, S11. However, for safety reasons the mobile monitoring device 20 is not immediately deactivated. Before deactivating, it is determined whether the pressure signal indicates the pressure P in the fluid line 8 is below the predetermined off threshold $P_{OFF}$, S12. If the pressure signal indicates that the pressure P in the fluid line 8 is below the predetermined off threshold $P_{OFF}$, this indicates that the wearer has closed the cylinder valve 5 having exited the hazardous environment. Therefore, the mobile monitoring device 20 is deactivated, S1.

However, if the pressure signal indicates that the pressure P in the fluid line 8 is above the predetermined off threshold $P_{OFF}$, then the process returns to resetting the base pressure $P_{BASE}$, S5, and determining if breathing has commenced, S6. This prevents the mobile monitoring device 20 from being inadvertently deactivated when the breathing apparatus 2 is still in use.

In other embodiments, the mobile monitoring device 20 may be activated based on independent positive determinations by both the gas supply detector module and the breathing detector module, as opposed to first determining that the breathable gas is being supplied and subsequently determining that breathing has commenced.

Although an embodiment of the invention has been described in which the gas supply detector module and the breathing detector module are located within the mobile monitoring device itself, it will be appreciated that in other embodiments either one or both modules may be located outside of the mobile monitoring device. For example, the mobile gas supply detector module and/or the breathing detector module could be integrated with the pressure detecting device, the facemask, the fluid line or otherwise integrated to or coupled to the gas supply. It will be appreciated that the modules may comprise software operating on a processor. Further, one or both modules may communicate with the mobile monitoring device and/or with each other via a wired or wireless link. In embodiments where communication between the modules and/or the mobile monitoring device is by a wireless link, activation of the breathing detector module and/or the mobile monitoring device respectively may be effected by transmitting a predetermined number of activation or ON signals and listening for at least one ON signal, as described in detail in GB 2 496 402.

Whilst embodiments of the invention have been described in which the breathing detector module monitors the pressure signal and determines that breathing has commenced when the pressure signal indicates that an overall pressure drop has occurred, it will be appreciated that the breathing detector module may determine if breathing has commenced based on other criteria, either as an alternative or in addition to that described above. For example, the breathing detector module may determine that breathing has commenced when the pressure signal indicates a rate of pressure drop $P_R$ in the fluid line or breathable gas supply exceeding a threshold pressure rate drop.

Further, whilst embodiments of the invention have been described in which the breathing detector module monitors the pressure signal from the pressure detecting device alone, it will be appreciated that in alternative embodiments (not shown), the breathing detector module may be arranged to determine whether breathing has commenced based on a flow rate signal generated by a flow sensor and in addition to or as an alternative to the pressure signal. In such embodiments, the breathing detector determines that breathing has commenced when the flow rate of breathable gas to the delivery device exceeds a predetermined flow rate indicative of breathing. The flow sensor may be incorporated in the delivery device 6 or may be installed in the fluid line between the gas supply and the delivery device. The breathing detector module may be arranged to determine if breathing has commenced based on the flow rate signal alone, or based on the flow rate signal and/or the pressure signal from a pressure detecting device. For example, the breathing detector module may have two or more independent breathing criteria by which it determines that breathing has commenced. One or more breathing criteria may relate to the pressure signal (as described above) and one or more may relate to the flow rate signal.

Although embodiments of the invention have been described in which the pressure detecting device transmits a pressure signal corresponding to the pressure of the gas in the fluid line, and may display the pressure on a display, it will be appreciated that in embodiments of the invention the pressure of the gas in the fluid line need not be derived or derivable from the pressure signal. For example, the pressure signal may only be proportional to the pressure of the gas in the fluid lines 3, 8. In such cases, it would still be possible to configure the predetermined thresholds of the gas supply detector module to correspond to actual pressure values by calibration.

It will be appreciated that the gas supply module and the breathing detector module may be operational even if they are incorporated in the mobile monitoring device and the mobile monitoring device is in a deactivated state.

Although embodiments of the invention have been described in which it must be determined that both the gas supply is supplying breathable gas to the delivery device and that breathing has commenced before the mobile monitoring device is activated, it will be appreciated that in other embodiments, there may be no gas supply detector module and the mobile monitoring device may be activated based on a determination that breathing has commenced alone.

Although embodiments of the invention have been described in which the breathing detector module commences determining whether breathing is occurring only when it has been determined that the gas supply is supplying breathable gas to the delivery device, it will be appreciated that in other embodiments the breathing detector module may commence determining in response to a manual activation of the breathing detector. For example, the breathing detector module may start determining if breathing has commenced when a tally key is removed from the mobile monitoring device, which typically indicates that the user is preparing to enter a hazardous environment.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

The invention claimed is:

1. A monitoring apparatus for monitoring a wearer of breathing apparatus including a source of breathable gas which in use is supplied to a delivery device, such as a face mask and/or a lung demand valve, via a fluid line, the monitoring apparatus comprising:

a pressure sensor arranged to generate a pressure signal relating to the pressure of fluid in the fluid line;

a breathing detector arranged to determine if breathing using the breathing apparatus has commenced, the breathing detector being arranged to monitor the pressure signal and to determine if breathing has commenced based on the pressure signal;

a gas supply detector arranged to determine if breathable gas is being supplied to the delivery device; and a mobile monitoring device arranged to be associated with the wearer and which can be activated to monitor the motion of the wearer;

wherein the apparatus is arranged to activate the mobile monitoring device when it is determined that both breathable gas is being supplied to the delivery device and breathing using the breathing apparatus has commenced.

2. A monitoring apparatus for monitoring a wearer of breathing apparatus including a source of breathable gas which in use is supplied to a delivery device via a fluid line, the monitoring apparatus comprising:

a breathing detector arranged to determine if breathing using the breathing apparatus has commenced; a gas supply detector arranged to determine if breathable gas is being supplied to the delivery device; and a mobile monitoring device arranged to be associated with the wearer and which can be activated to monitor the motion of the wearer;

wherein the apparatus is arranged to activate the mobile monitoring device when it is determined that both breathable gas is being supplied to the delivery device and breathing using the breathing apparatus has commenced.

3. A monitoring apparatus according to claim 2, wherein the breathing detector is arranged to monitor a signal relating to a parameter of fluid in the fluid line, and to determine if breathing has commenced based on the signal.

4. A monitoring apparatus according to claim 3, wherein the signal comprises a pressure signal relating to the pressure of fluid in the fluid line.

5. A monitoring apparatus according to claim 4, wherein the monitoring apparatus comprises a pressure sensor which is arranged to generate the pressure signal.

6. A monitoring apparatus according to claim 4, wherein the breathing detector determines that breathing has commenced when the pressure signal indicates that the pressure of fluid in the fluid line has fallen by at least a predetermined pressure.

7. A monitoring apparatus according to claim 4, wherein the breathing detector determines that breathing has commenced when the pressure signal indicates that the pressure of fluid in the fluid line has fallen at a rate that is at least a predetermined rate.

8. A monitoring apparatus according to claim 3, wherein the signal comprises a flow rate signal relating to the flow rate of fluid in the fluid line.

9. A monitoring apparatus according to claim 8, wherein the monitoring apparatus comprises a flow rate sensor which is arranged to generate the flow rate signal.

10. A monitoring apparatus according to claim 8, wherein the breathing detector determines that breathing has commenced when the flow rate signal indicates that the flow rate of fluid in the fluid line is at least a predetermined flow rate.

11. A monitoring apparatus according to claim 2, wherein the apparatus is arranged such that the breathing detector starts determining if breathing has commenced only once the gas supply detector has detei mined that breathable gas is being supplied to the delivery device.

12. A monitoring apparatus according to claim 2, wherein the gas supply detector is arranged to monitor a signal relating to a parameter of fluid in the fluid line, such as a pressure signal relating to the pressure of fluid in the fluid line, and wherein the gas supply detector determines if breathable gas is being supplied based on the signal.

13. A monitoring apparatus according to claim 12, wherein the signal is a pressure signal relating to the pressure of fluid in the fluid line, and wherein the breathing detector determines that breathable gas is being supplied when the pressure signal indicates that the pressure of fluid in the fluid line is at least a predetermined pressure.

14. A monitoring apparatus according to claim 13, wherein the monitoring apparatus comprises a pressure sensor which generates a pressure signal relating to the pressure of fluid in the fluid line.

15. A breathing apparatus comprising:

a source of breathable gas fluidically coupled to a delivery device, such as a face mask and/or a lung demand valve, via a fluid line, such that in use breathable gas can be supplied to the delivery device via the fluid line; and a monitoring apparatus having a breathing detector arranged to determine if breathing using the breathing apparatus has commenced; a gas supply detector arranged to determine if breathable gas is being supplied to the delivery device; and a mobile monitoring device arranged to be associated with a wearer of breathing apparatus and which can be activated to monitor the motion of the wearer; wherein the monitoring apparatus is arranged to activate the mobile monitoring device when it is determined that both breathable gas is being supplied to the delivery device and breathing using the breathing apparatus has commenced.

16. The breathing apparatus according to claim 15, wherein the source of breathable gas comprises a cylinder of breathable gas.

17. A method of activating a mobile monitoring device which is arranged to be associated with a wearer of breathing apparatus comprising a source of breathable gas which in use is supplied to a delivery device via a fluid line, the method comprising:

determining, by a breathing detector, if breathing using the breathing apparatus has commenced; determining, by a gas supply detector, if breathable gas is being supplied to the delivery device; and activating the mobile monitoring device to monitor the motion of the wearer when it is determined that both breathing has commenced and breathable gas is being supplied to the delivery device.

18. A method according to claim 17, wherein the delivery device is a face mask and/or a lung demand valve.

* * * * *